US009630228B2

(12) United States Patent
Riches

(10) Patent No.: US 9,630,228 B2
(45) Date of Patent: Apr. 25, 2017

(54) DUAL CASCADE CONTROL SYSTEM FOR A LONG ROLLING MILL

(71) Applicant: Paul Barry Riches, Paxton, MA (US)

(72) Inventor: Paul Barry Riches, Paxton, MA (US)

(73) Assignee: PRIMETALS TECHNOLOGIES USA LLC, Alpharetta, GA (US)

( * ) Notice: Subject to any disclaimer, the term of this patent is extended or adjusted under 35 U.S.C. 154(b) by 385 days.

(21) Appl. No.: 13/740,713

(22) Filed: Jan. 14, 2013

(65) Prior Publication Data

US 2013/0186157 A1 Jul. 25, 2013

Related U.S. Application Data

(60) Provisional application No. 61/588,235, filed on Jan. 19, 2012.

(51) Int. Cl.

| | |
|---|---|
| ***B21B 37/46*** | (2006.01) |
| ***B21B 39/02*** | (2006.01) |
| *B21B 1/46* | (2006.01) |
| *B21B 39/08* | (2006.01) |

(52) U.S. Cl.

CPC ..... *B21B 39/02* (2013.01); *B21B 37/46* (2013.01); *B21B 1/463* (2013.01); *B21B 39/084* (2013.01); *B21B 2275/02* (2013.01); *B21B 2275/04* (2013.01)

(58) Field of Classification Search

CPC . B21B 37/46; B21B 2275/02; B21B 2275/04; B21B 2275/06; B21B 39/02; B21B 39/084; B21B 1/463

USPC ..... 72/8.3, 8.8, 11.1, 11.2, 11.5, 12.5; 700/151

See application file for complete search history.

(56) References Cited

U.S. PATENT DOCUMENTS

| | | | | |
|---|---|---|---|---|
| 5,235,834 | A * | 8/1993 | Bolkey | B21B 37/52 72/12.5 |
| 5,794,473 | A * | 8/1998 | Palzer | 72/8.9 |
| 2002/0177972 | A1* | 11/2002 | Riches et al. | 702/142 |
| 2008/0276679 | A1* | 11/2008 | Eckerstorfer et al. | 72/38 |

(Continued)

FOREIGN PATENT DOCUMENTS

WO 2010049338 A2 5/2010

OTHER PUBLICATIONS

Hiroyuki Imanari, et al. "New Process Control System in Hot Strip Mill of North Star BHP Steel". Iron and Steel Engineer, vol. 76, No. 8, Aug. 1999 (pp. 32-37).

(Continued)

*Primary Examiner* — David B Jones

(74) *Attorney, Agent, or Firm* — Gesmer Updegrove LLP

(57) ABSTRACT

A system for maintaining a continuous speed in a long rolling mill is provided that includes a plurality of guide rollers that feed a billet product from a caster to an entry roll stand along a mill pass line to an exit roll stand. Also, the system includes a plurality of gauges positioned at a plurality of locations along the mill pass line, the gauges perform speed measurement of the billet product passing along the guide rollers. Furthermore, the system includes a logic controller that receives the speed measurement and maintains a speed relationship where the speed between the caster and the entry roll stand is constant as well as the exit speed of the end roll stand is also constant.

16 Claims, 1 Drawing Sheet

(56) References Cited

U.S. PATENT DOCUMENTS

2011/0239722 A1* 10/2011 Gruss et al. ..... 72/234

OTHER PUBLICATIONS

PCT International Search Report mailed Apr. 24, 2013 corresponding to PCT International Application No. PCT/US2013/021640 filed Jan. 16, 2013 (10 pages).

* cited by examiner

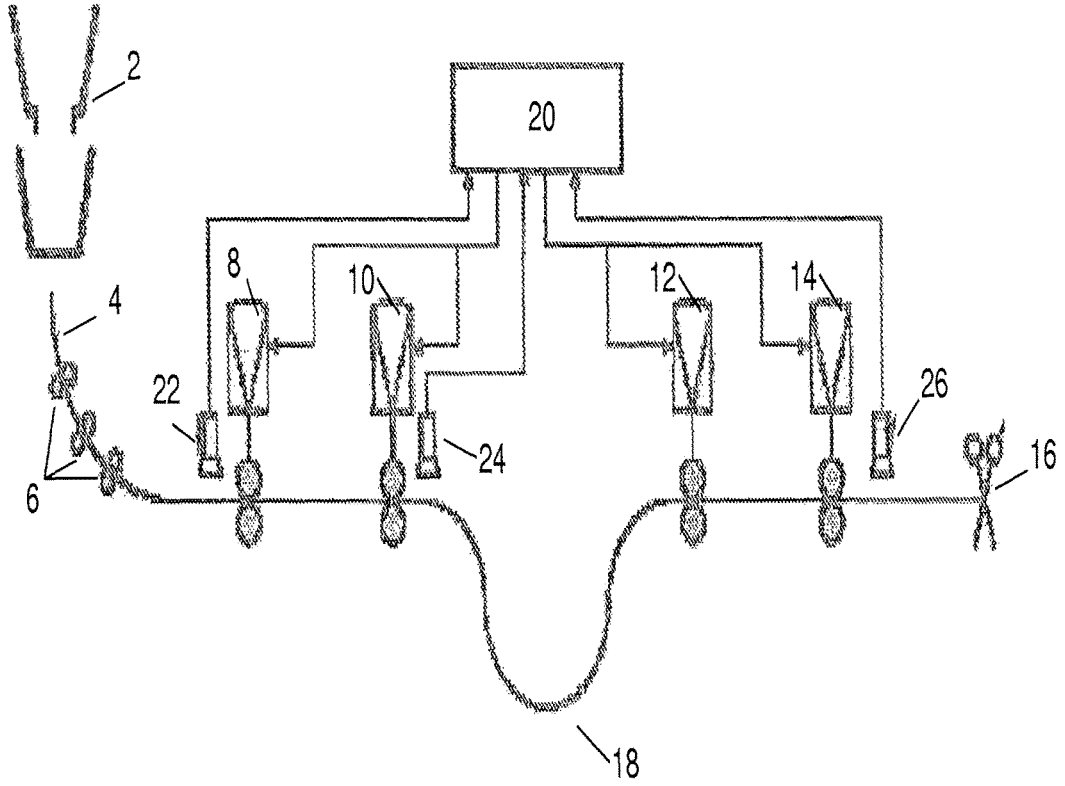
2
20
8
10
12
14
4
22
26
24
16
6
18

DUAL CASCADE CONTROL SYSTEM FOR A LONG ROLLING MILL

PRIORITY INFORMATION

This application claims priority from provisional application Ser. No. 61/588,235 filed Jan. 19, 2012, which is incorporated herein by reference in its entirety.

BACKGROUND OF THE INVENTION

The invention is related to the field of long rolling mills, and in particular to a dual cascade control system for long rolling mills.

In a conventional bar mill, the cascade system is defined from the product exit position back towards the entry stand. This ensures that the finishing process is a stable process. However, recognizing the advances of science and technology in these mills, any problem in the steelmaking, casting or rolling processes may create a stoppage or breakdown of the complete line, thereby presenting a bottleneck. Subsequently, there exists the possibility of loss of production and incurred expenses and time for any necessary replacement of equipment materials.

SUMMARY OF THE INVENTION

According to one aspect of the invention, there is provided a system for maintaining a continuous speed in a long rolling mill. The system includes a plurality of guide rollers that feed a billet product from a caster to an entry roll stand along a mill pass line to an exit roll stand. Also, the system includes a plurality of gauges positioned at a plurality of locations along the mill pass line, the gauges perform speed measurement of the billet product passing along the guide rollers. Furthermore, the system includes a logic controller that receives the speed measurement and maintains a speed relationship where the speed between the caster and the entry roll stand is constant as well as the exit speed of the end roll stand is also constant.

According to another aspect of the invention, there is provided a method for maintaining a speed of a billet product moving along a rolling mill. The method includes feeding the billet product from a caster to an entry roll stand along a mill pass line to an exit roll stand. Also, the method includes positioning a plurality of gauges at a plurality of locations along the mill pass line. The gauges perform speed measurement of the billet product passing along the guide rollers. Furthermore, the method includes receiving the speed measurement and maintaining a speed relationship where the speed between the caster and the entry roll stand is constant as well as the exit speed of the end roll stand is also constant.

BRIEF DESCRIPTION OF THE DRAWINGS

The FIGURE is a schematic diagram illustrating a long rolling mill operating in sequence with a continuous caster.

DETAILED DESCRIPTION OF THE INVENTION

The invention involves a control system that ensures the speed relationship between a caster and the speed of an entry roll stand is constant as well as ensuring that the exit speed of the end roll stand is also constant. This is achieved by utilizing loop storage and cascading a first set of roll stands downstream, and a cascading of a second set of roll stands upstream. By utilizing velocity and length measurement from a plurality of gauges, the speed of the rolled product can be controlled, and the length of the cut of the rolled product by the shear can be controlled.

The FIGURE shows an exemplary embodiment of the invention, depicting a long rolling mill operating in sequence with a continuous caster 2. The caster 2 produces a billet product 4 fed by means of a plurality of guide rollers 6 to a first or entry roll stand 8. This stand 8 is the entry roll stand of the mill, and is followed by a succession of additional roll stands 10, 12 and ending with an exit roll stand 14, from which the finished rolled product exits for subdivision by a shear 16 into lengths specified by a customer. Note the invention can have n number of roll stands.

The invention includes a programmable logic controller (PLC) 20 or programmable controller. The PLC 20 is a digital computer used for automation of electromechanical processes, such as control of machinery on factory assembly lines, amusement rides, or light fixtures. Unlike general-purpose computers, the PLC 20 is designed for multiple inputs and output arrangements, extended temperature ranges, immunity to electrical noise, and resistance to vibration and impact. Programs to control machine operation are typically stored in battery-backed-up or non-volatile memory. The PLC 20 is a real time system since output results must be produced in response to input conditions within a limited time, otherwise unintended operation will result.

The PLC 20 includes embedded code that is part of a processor, e.g., S7416, adapted to ensure that the speed relationship between the caster 2 and the entry roll stand 8 is constant, and that the delivery speed of the exit roll stand 14 to the shear 16 is also constant. Note the PLC 20 controls all the mill functions to ensure the product is rolled correctly, this includes, loop regulation, minimum tension control, and the like. Importantly with respect to the invention, the PLC 20 ensures the relationship of the caster pouring speed and entry roll stand 8 entry speed are matched.

These speeds are achieved by introducing a loop storage 18 and the PLC 20, which are responsive to the stock speed measurements of gauges 22, 24 and 26. Each of the gauges 22, 24 and 26 are strategically positioned at locations along the mill pass line. The loop storage 18 is positioned between stand 10 and stand 12.

The speed measurement of gauge 22 is used to match the rolling speed of the entry stand 8 with the speed of the billet product 4 exiting from the caster 2. Corresponding speed adjustments are cascaded downstream to stand 12. Gauge 26 measures the speed of the rolled product 4 exiting from the exit stand 14, and speed adjustments that are required to maintain a constant exiting speed of the rolled product 4 are cascaded upstream from the exit stand 14 to stand 12.

The PLC 20 receives the speed measurement from gauges 22, 24, 26 and using its embedded code computes the speed required for the billet product 4 from caster 2. The PLC 20 includes embedded code that allows it to communicate with the various entry rolls 8, 10, 12, 14 to adjust their respective speeds to maintain a constant exiting speed of the billet product 4.

Loop variation and storage at loop storage 18 minimizes the effects of cascading in two different directions. With a large sectional area and a low rate of change, this allows for cascade compensation in two directions to compensate for equipment wear and temperature changes.

The speed measurement of gauge 22 is used during mill set up, as well as for speed monitoring and regulation of the entry stand 8. The speed measurement of gauge 24 is used to monitor the exit speed of stand 10 to set up stand 12 during threading of the billet product 4 through the mill, and to monitor and control a height of the loop 18. The speed measurement of gauge 26 is used to control the operation of shear 16 in order to subdivide the exiting rolled product into accurate lengths specified by the customer.

The entry roll stand must follow the casting speed. Because the exit roll stand speed is more dynamic than the casting process, this exit roll stand speed will follow the casting speed. When the entry speed is adjusted, the relationship between the entry roll stand and the successive roll stand needs to remain constant at the same rate.

The invention utilizes loop growth and storage to minimize the effects of cascading in two directions—with a large sectional area and a low rate of change, this will allow for cascade compensation in both directions to compensate for equipment wear and temperature changes. Moreover, the invention use speed measurement gauges at an entry roll stand for set up, speed monitoring and regulation of the entry roll stand, and a speed measurement gauge at a roll stand successive to the entry roll stand to set up a subsequent roll stand during threading to monitor a height of the loop for accuracy and re-adjust if possible, and to also monitor an exit speed of the successive roll stand. A speed measurement gauge is positioned at the subsequent roll stand to control cut length to either customer piece or customer length, even if the mill is cascading at a slow rate of change. Moreover, the invention utilizes a dynamic control system to decide appropriate action based on loop growth or decline to correct the appropriate mill section.

Although the present invention has been shown and described with respect to several preferred embodiments thereof, various changes, omissions and additions to the form and detail thereof, may be made therein, without departing from the spirit and scope of the invention.

What is claimed is:

1. A speed control system for a long rolling mill having a pass line defined by a plurality of roll stands beginning with an entry roll stand and terminating at an exit roll stand, said entry roll stand being positioned to receive a billet product produced by a caster, said control system comprising:

a plurality of gauges for performing speed measurements of the billet product at a plurality of locations along the pass line;

a logic controller that operates in response to the speed measurements received from the gauges to maintain a speed relationship where the speed of the entry roll stand is adjusted to match the variable output speed of the caster as well as to maintain a constant delivery speed of the exit roll stand constant, the logic controller communicates with one or more other roll stands positioned between the entry roll stand and exit roll stand to adjust their respective delivery speeds in order to maintain the constant delivery speed at the exit roll stand, the adjusted delivery speeds are cascaded upstream from the exit roll stand to the one or other roll stands so as to maintain the constant delivery speed at the exit roll stand; and a loop storage that minimizes a plurality of effects of cascading in two directions to compensate for equipment wear and temperature changes.

2. The system of claim 1, wherein the gauges comprise a first gauge that monitors speed and regulation of the entry roll stand.

3. The system of claim 2, wherein the first gauge matches a rolling speed of the entry roll stand and the logic controller matches a speed of the billet product exiting from the caster using the logic controller.

4. The system of claim 3 further comprising a plurality of corresponding speed adjustments that are cascaded downstream to a third roll stand that is successive to the entry roll stand.

5. The system of claim 1, wherein the gauges comprise a second gauge that monitors an exit speed of a second roll stand that is successive to the entry roll stand, to set up a third roll stand that is successive to the second roll stand during threading of the billet product, and to monitor and control a height of a loop storage.

6. The system of claim 1, wherein the gauges comprise a third gauge that measures a speed of the rolled product exiting from an end roll stand using the logic controller.

7. The system of claim 6, wherein the logic controller performs the speed adjustments that are required to maintain the constant exiting speed of rolled product are cascaded upstream from end roll stand to a third roll stand that is successive to the entry roll stand.

8. The system of claim 1 further comprising a loop storage that minimizes a plurality of effects of cascading in two directions to compensate for equipment wear and temperature changes.

9. A method for maintaining a speed of a billet product moving along a rolling mill, comprising the steps of:

providing a pass line defined by a plurality of roll stands beginning with an entry roll stand and terminating at an exit roll stand, said entry roll stand being positioned to receive a billet product produced by a caster;

positioning a plurality of gauges at a plurality of locations along the mill pass line, the gauges perform speed measurements of the billet product passing along the pass line; and providing a logic controller that receives the speed measurements from the gauges to maintain a speed relationship where the speed of the entry roll stand is adjusted to match the variable output speed of the caster as well as to maintain a constant delivery speed of the exit roll stand constant, the logic controller communicates with one or more other roll stands positioned between the entry roll stand and exit roll stand to adjust their respective delivery speeds in order to maintain the constant delivery speed at the exit roll stand, the adjusted delivery speeds are cascaded upstream from the exit roll stand to the one or other roll stands so as to maintain the constant delivery speed at the exit roll stand; and providing a loop storage that minimizes a plurality of effects of cascading in two directions to compensate for equipment wear and temperature changes.

10. The method of claim 9, wherein the gauges comprise a first gauge that monitors speed and regulation of the entry roll stand.

11. The method of claim 10, wherein the first gauge measures a rolling speed of the entry roll stand which the logic controller uses to match with a speed of the billet product exiting from the caster.

12. The method of claim 11 further comprising a plurality of corresponding speed adjustments that are cascaded downstream to a third roll stand that is successive to the entry roll stand.

13. The method of claim 9, wherein the gauges comprise a second gauge that monitors an exit speed of a second roll stand, to set up a third roll stand during threading of the billet product, and to monitor and control a height of a loop storage.

14. The method of claim 9, wherein the gauges comprise a third gauge that measures a speed of the rolled product exiting from an end roll stand.

15. The method of claim 14, wherein the logic controller performs the speed adjustments that are required to maintain a constant exiting speed of rolled product are cascaded upstream from end roll stand to a third roll stand that is successive to the entry roll stand.

16. The method of claim 9 further comprising loop storage that minimizes a plurality of effects of cascading in two directions to compensate for equipment wear and temperature changes.

* * * * *